United States Patent [19]

Murasaki

[11] Patent Number: 4,760,625

[45] Date of Patent: Aug. 2, 1988

[54] METHOD FOR PRODUCING HOOKS ON HOOK-AND-LOOP FASTENERS

[75] Inventor: Ryuichi Murasaki, Toyama, Japan

[73] Assignee: Yoshida Kogyo K. K., Tokyo, Japan

[21] Appl. No.: 940,956

[22] Filed: Dec. 12, 1986

[30] Foreign Application Priority Data

Dec. 12, 1985 [JP] Japan ..... 60-279492

[51] Int. Cl.[4] ..... A44B 18/00; D06C 13/08

[52] U.S. Cl. ..... 26/9; 28/161; 139/291 C

[58] Field of Search ..... 26/9; 28/161; 139/291 C, 43; 24/442, 445

[56] References Cited

U.S. PATENT DOCUMENTS

| | | | |
|---|---|---|---|
| 2,933,797 | 4/1960 | Mestral | 26/9 |
| 3,616,501 | 11/1971 | Waller | 26/9 |
| 3,727,433 | 4/1973 | Hamano | 26/9 UX |
| 3,982,309 | 9/1976 | Gilpatrick | 26/9 |
| 4,271,568 | 6/1981 | Durville et al. | 26/9 |
| 4,429,441 | 2/1984 | Nishiyama et al. | 26/9 |

FOREIGN PATENT DOCUMENTS

| | | | |
|---|---|---|---|
| 42-13511 | 8/1967 | Japan . | |
| 422406 | 4/1967 | Switzerland | 26/9 |

*Primary Examiner*—Robert R. Mackey

*Attorney, Agent, or Firm*—Hill, Van Santen, Steadman & Simpson

[57] ABSTRACT

An improved method and apparatus for producing hooks on hook-and-loop fasteners, wherein loops on a loop sheet are cut from the outside thereof on one of the legs thereof near loop heads by reciprocating first movable cutting comb teeth of a first movable blade in a direction perpendicular to the axes of first stationary cutting comb teeth of a stationary blade while the loops are guided along the first stationary cutting comb teeth, thereby producing a hook from each loop thus severed, and then the severed leg of each severed loop is further cut from the outside of the loop near a foundation fabric by reciprocating second movable cutting comb teeth of a second movable blade in a direction perpendicular to the axes of second stationary cutting comb teeth of the stationary blade while the severed leg is held in one of the two adjacent guide grooves defined in the stationary blade.

1 Claim, 4 Drawing Sheets

METHOD FOR PRODUCING HOOKS ON HOOK-AND-LOOP FASTENERS

BACKGROUND OF THE INVENTION

1. Field of the Invention

The present invention relates to a method of and an apparatus for producing hooks on surface-type fasteners known as hook-and-loop fasteners by cutting uncut loops on a base sheet on one of the legs thereof.

2. Prior Art

According to a known method and apparatus disclosed in Japanese Patent Publication No. 42-13511, published Aug. 1, 1967, and reillustrated here in FIGS. 7 and 8, a comb-like stationary cutter blade A of a given thickness and a pair of comb-like movable cutter blades B, B disposed on opposite sides of the stationary cutter blade A are inserted into loops C on a base sheet while the latter is fed along a path, and then the movable cutter blades B, B are horizontally reciprocated to cut the loops C on one of the legs thereof simultaneously at two different points, thereby producing hooks each of which has a relatively large loop-accepting passage or space substantially equal to the thickness of the stationary cutter blade A.

The known practice, however, has various drawbacks: The cutter blades A, B must be narrow and thin enough to pass through such small loops having a height of about 2 mm and hence they are difficult to manufacture at a low cost. The movable cutter blades B further need to be rigid enough to cut the loops of monofilament. Such rigid but thin movable cutter blades B are likely to be damaged and sometimes broken during the cutting operation. The possibility of cutter breakage increases as the cutting speed or the reciprocating motion of the movable cutter blades B is increased. Additionally, the thin stationary cutter blade A is liable to vibrate in resonance with the reciprocation of the movable cutter blades B, thus making it difficult to cut all the loops at the same points of severance. Consequently, the resulting hooks have non-uniform shapes and configurations and provide only a low strength of engagement when coupled with loops of a mating fastener part. A further disadvantage is that the loop-accepting spaces of the hooks, which depend on the thickness of the stationary cutter blade A, can be adjusted only by replacing stationary cutter blade A with another stationary cutter blade having a different thickness.

SUMMARY OF THE INVENTION

It is accordingly a general object of the present invention to provide an improved method and apparatus for producing hooks on hook-and-loop fasteners, which can overcome or substantially eliminate the foregoing drawbacks of the known practice.

A more specific object of the present invention is to provide a method and apparatus for producing hooks on hook-and-loop fasteners by severing uncut loops twice on one of the legs thereof accurately at two different points by means of a loop cutter having a stationary blade and two movable blades, each of which is relatively thick and durable in construction, is free from resonant vibration and can be manufactured easily at a low cost.

Another object of the present invention is to provide a method and apparatus for producing hooks on hook-and-loop fasteners, which can provide various loop-accepting passages or spaces with the hooks.

According to the present invention, loops of a loop sheet are guided along first cutting comb teeth of a stationary blade as the loop sheet is fed along a path, then the loops are cut from the outside thereof on one of the legs near the loop heads by reciprocating first movable cutting comb teeth of a first movable blade in a direction perpendicular to the axes of the comb teeth while the loops are guided along the first stationary cutting comb teeth thereby producing a hook from each loop thus severed, thereafter the severed leg and the hook of each severed loop are guided to move in and along an adjacent pair of parallel spaced guide grooves defined in the stationary blade, and finally the severed leg of each severed loop is further cut from the outside of the loop near a foundation fabric by reciprocating second movable cutting comb teeth of a second movable blade in a direction perpendicular to the axes of second stationary cutting comb teeth of the stationary blade while the severed leg is held in one of the two adjacent guide grooves.

Since the loops are held on or in the portions (the first stationary comb teeth or the guide grooves) in the stationary blade, an accurate and stable loop severing is achieved. Both the movable blades are normally disposed outside the loops to be severed and hence it is possible to make the movable blades thick and durable in construction. The stationary and movable blades are vertically and horizontally movable in unison for adjusting the cutting points on the loops, thereby varying the loop-accepting passages or spaces of the hooks.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
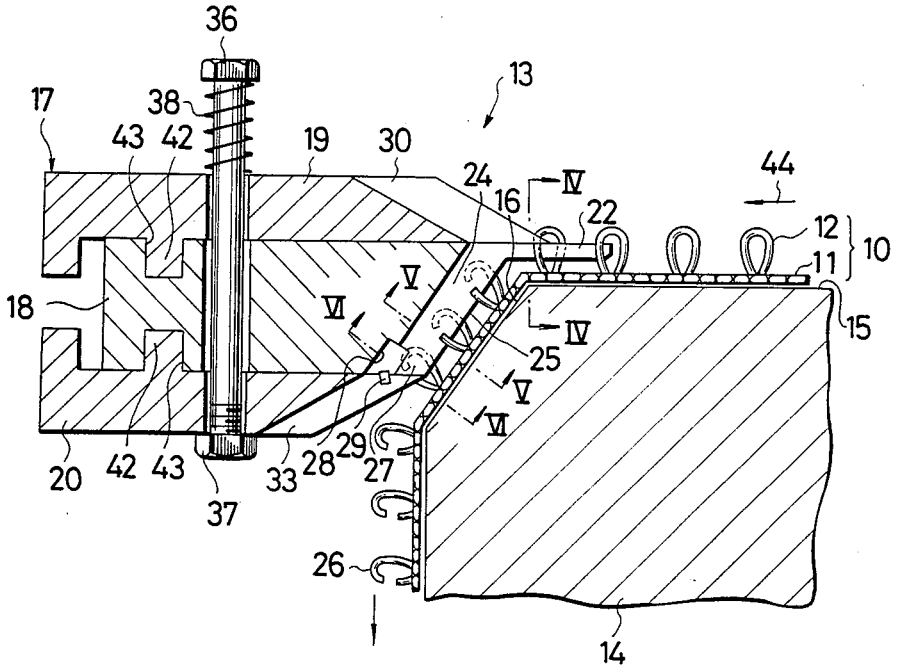
FIG. 1 is a fragmentary cross-sectional view of an apparatus for producing hooks on hook-and-loop fasteners according to the present invention.
Figure 3:
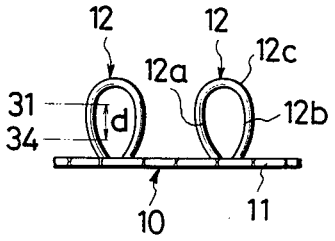
FIG. 3, appearing with FIG. 1, is an enlarged fragmentary end elevational view of a loop sheet having loops from which hooks are produced by the apparatus shown in FIG. 1.
Figure 7:
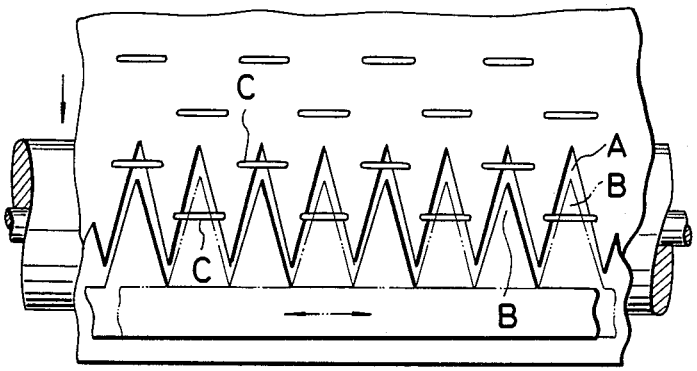
FIG. 7 PRIOR ART
FIG. 7 is a fragmentary plan view of a known apparatus.
Figure 8:
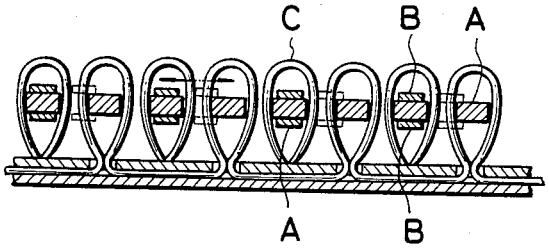
FIG. 8 PRIOR ART
FIG. 8 is a cross-sectional view illustrative of the operation of loop cutter of the known apparatus shown in FIG. 7.

As shown in FIGS. 1 and 3, a loop sheet or tape 10 is composed of a foundation fabric 11 and a multiplicity of projecting uncut loops 12 of thermoplastic synthetic resin monofilament interwoven or interknitted in the foundation fabric 11 and arranged in rows and tiers at predetermined intervals or pitches. The loops 12 in transverse rows are longitudinally aligned in tiers. Each loop 12 has, as shown in FIG. 3, a pair of legs 12*a*, 12*b* interconnected by an arcuate head 12*c*, the legs 12*a*, 12*b* being spaced from each other transversely of the foundation fabric 11. The loop sheet 10 may be of the type, as shown in FIG. 7, having a multiplicity of projecting loops arranged in transverse rows and longitudinal tiers, the loops in alternate transverse rows being transversely staggered by half the loop pitch in each transverse row, and the staggered loops in alternating transverse rows being longitudinally aligned in tiers.

An apparatus 13 for producing hooks according to the present invention comprises a sheet or tape guide 14 for slidably supporting the loop sheet 10 which is continuously or intermittently fed along a longitudinal path by a suitable sheet feed mechanism (not shown). The loop sheet 10 as it is fed on and along an upper horizontal guide surface 15 of the sheet guide 14 turns around a downwardly sloping flat corner guide surface 16 and then is moved in a downward vertical direction, as shown in FIG. 1.

The apparatus also includes a loop cutter 17 composed of stationary blade 18 and a pair of upper and lower movable blades 19, 20 slidably disposed on opposite sides of the stationary blade 18.

Figure 2:
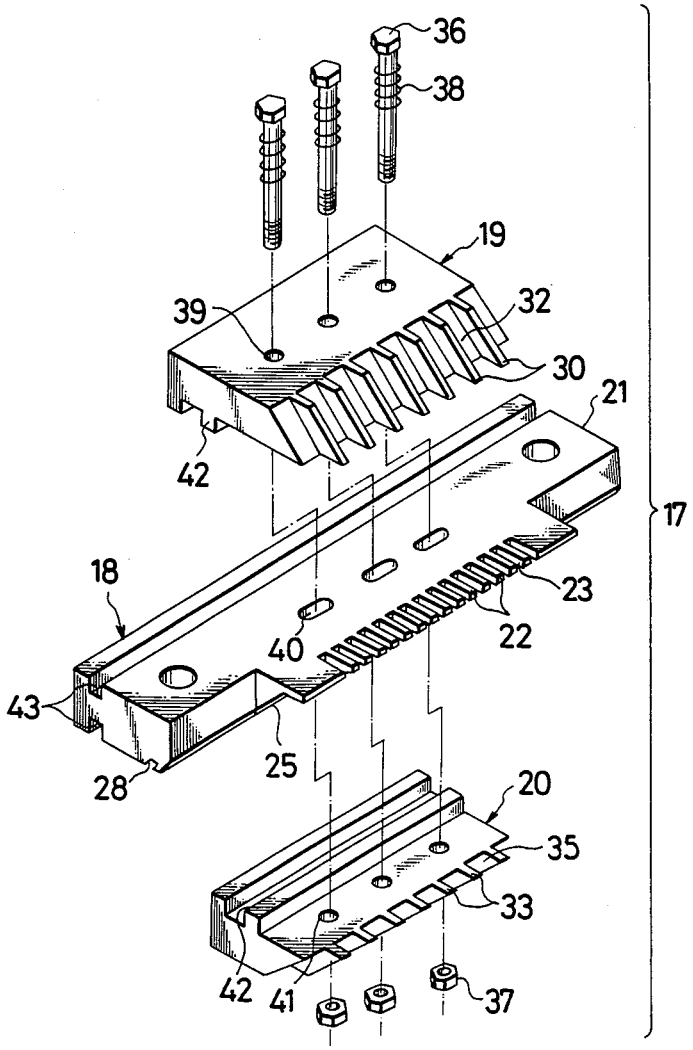
FIG. 2 is an exploded perspective view of a loop cutter of the apparatus shown in FIG. 1.
Figure 5:
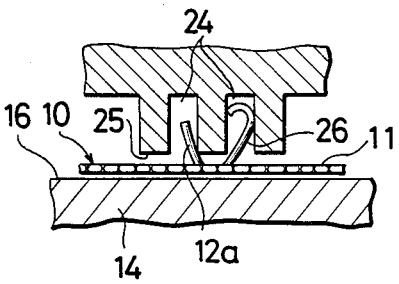
FIG. 5 is a cross-sectional view taken along V—V of FIG. 1.

As shown in FIG. 2, the stationary blade 18 includes a substatially rectangular body 21 and a plurality of equally spaced, parallel cutting teeth 22 in the form of a comb projecting horizontally from an upper longitudinal edge of the body 21 in overhanging relation to the sheet guide surface 15 (FIG. 1) for being inserted in the loops 12 and for cutting the loops 12, as described below. The comb teeth 22 have longitudinal axes transversely spaced by a distance equal to the half of the pitch or interval between each adjacent pair of loops 12 in one of transverse rows of the loops 12. The comb teeth 22 have a substantially square uniform cross-sectional shape throughout the length thereof and define therebetween a plurality of guide slots 23 opening toward the sheet guide 14 for receiving the legs 12*a*, 12*b* of the loops 12 as the loops 12 are advanced along the comb teeth 22. The stationary blade 18 further includes a plurality of guide grooves 24 extending contiguously from the closed ends of the respective guide slots 23 downwardly across a bevelled surface 25 of the cutter body 21. The bevelled surface 25 extends parallel to the corner guide surface 16 of the sheet guide 14 in confronting relation to the guide surface 16 so that the loops 12 after their first severance are advanced in and along the guide grooves 24. The guide grooves 24 each have a width and a depth which are large enough to allow passage of the cut loops 12 in such a manner as shown in FIG. 5 in which the severed leg 12*a* and a hook 26 which have been produced from each cut loop 12 are guidedly received respectively in two adjacent guide grooves 24 with the severed leg 12*a* held in a posture suitable for a second severance made at a point near the foundation fabric 11. The stationary blade 18 has on its lower surface a plurality of cutting teeth 27 (FIG. 1) in the form of a comb defining therebetween lower ends or outlets of the respective guide grooves 24, and an elongate channel 28 disposed adjacent to the outlets of the guide grooves 24 in communication with the latter and extending across the cutter body 21 in a direction perpendicular to the axes of the cutting teeth 22 for discharging cut debris 29 (one being shown in FIG. 1) produced during the second loop-cutting operation.

Figure 4A:
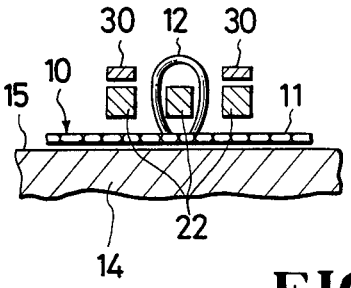
FIG. 4A is a cross-sectional view taken along line IV—IV of FIG. 1, showing the loop cutter in a first or standby position before effecting the first loop-cutting operation.

The upper movable blade 19 is slidably mounted on an upper surface of the stationary blade 18 and includes a plurality of parallel, equally spaced tapered cutting teeth 30 in the form of a comb. The comb teeth 30 are half in number of the comb teeth 22 of the stationary blade 18 and, as shown in FIG. 4A, they are disposed above every other of the comb teeth 22. The loops 12 are guided along the next adjacent comb teeth 22 extending between the comb teeth 22 above which the comb teeth 30 are disposed and hence the comb teeth 30 are normally disposed on the outer side of the loops 12. The comb teeth 30 are laterally movable into a position above the adjacent comb teeth 22 for effecting a first loop severance. The movable blade 19 is driven in a reciprocating movement in a direction perpendicular to the axes of the teeth 22, 30, through an amplitude or stroke substantially equal to the spacing between axes of two adjacent comb teeth 22 of the stationary blade 18 so that each loop 12 is cut only on one leg 12*a* at a first point 31 (FIG. 3) near the head 12*c* of the loop 12. Each of the comb teeth 30 has a width substantially equal to the width of each comb tooth 22 of the stationary blade 18. Since the comb teeth 30 are normally positioned outside of the loops 12 to be cut, it is not necessary to make the comb teeth 30 thin enough to be received in the loops 12 before the loop severance as in the case of the known comb teeth B (FIG. 7). Unlike the known comb teeth B, the comb teeth 30 are made thick and hence can be manufactured easily at a low cost, and are durable in construction. Between the comb teeth 30, there are defined a plurality of slots 32 (FIG. 2) opening toward the sheet guide 14.

Figure 6A:
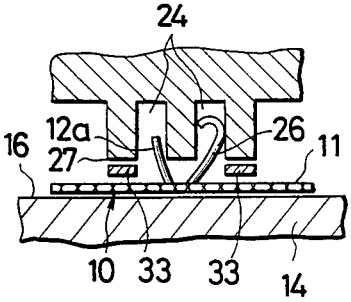
FIG. 6A is a cross-sectional view taken along line VI—VI of FIG. 1, showing the loop cutter in the first position before effecting a second loop-cutting operation.
Figure 6B:
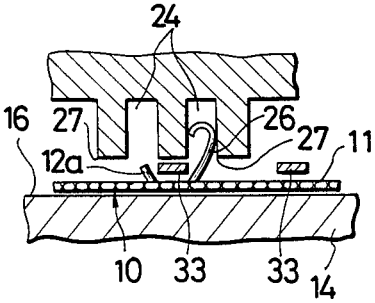
FIG. 6B is a view similar to FIG. 6A, showing the loop-cutter in the second position after the second loop-cutting operation.

The lower movable blade 20 which is disposed underneath the stationary blade 18 is structually and functionally the same as the upper movable blade 19. More specifically, the lower movable blade 20 is slidably disposed on a lower surface of the blade body 21 and has tapered comb teeth 33 for further cutting, in coaction with the comb teeth 22, the loops 12 on their legs 12*a* at a point 34 (FIG. 3) near the foundation fabric 11. The tapered comb teeth 33 are equally spaced by a plurality of slots 35 FIG. 2) defined therebetween so that the comb teeth 33 are disposed below every other comb teeth 22 of the stationary blade 18, as shown in FIG. 6A. The comb teeth 33 are normally disposed on the outer side of the loops 12 and are laterally movable in a position immediately below the next adjacent comb teeth 22 extending between the severed leg 12*a* and the hook 26 of each loop 12 for further severing the severed leg 12*a* (FIG. 6A to FIG. 6B).

The upper and lower movable blades 19, 20 are assembled with the stationary blade 18 by means of three sets of bolts 36 and nuts 37 with three compression coil springs 38 disposed between and acting between the respective bolts 36 and the upper movable blade 19. The bolts 36 respectively extend successively through three holes 39 in the upper movable blade 19, through three oblong holes 40 in the stationary blade 18, and through three holes 41 in the lower movable blade 20. Each of the upper and lower movable blades 19, 20 includes an elongate guide ridge 42 extending perpendicularly to the axes of the comb teeth 30, 33 and slidably received in one of a pair of elongate guide recesses 43 defined in the upper and lower surfaces of the stationary blade 18. The movable blades 19, 20 thus assembled are reciprocably movable in unison in a direction perpendicular to the axes of the teeth 22 of the stationary blade 18. The reciprocating motion of the movable blades 19, 20 is limited by the length of the elongate holes 40.

The loop cutter 17 is horizontally and vertically movable to adjust the positions of upper and lower pairs of the comb teeth 22, 30 and 22, 33 with respect to the sheet guide 14, thereby adjusting the distance d (FIG. 3) between the first and second cutting points 31, 34. With this adjustment, it is possible to vary loop-accepting passages or spaces of the hooks 26 in dependence on the distance d.

Figure 4B:
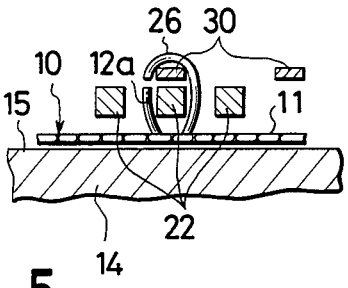
FIG. 4B is a view similar to FIG. 4A, showing the loop cutter in a second position after the first loop-cutting operation.

Operation of the apparatus 10 of the foregoing construction is as follows: When the loop sheet 10 is fed on and along the upper guide surface 15 in a direction of the arrow 44 (FIG. 1), alternate comb teeth 22 of the stationary blade 18 are inserted into the loops 12 in longitudinal tiers. A further advancing movement of the loop sheet 10 causes the loops 12 to enter into a first cutting region or a path of reciprocating movement of the comb teeth 30 of the upper movable blade 19 (FIG. 4A). Then the movable blade 19 is driven to shift its comb teeth 30 rightward from the position of FIG. 4A to the position of FIG. 4B, thereby cutting each loop 12 on one leg **12*a* at the first cutting point 31 (FIG. 3) near the head 12*c* thereof. The other legs 12*b* which have not been severed and the heads 12*c* will serve as hooks 26 on the loop sheet 10 for engagement with piles (not shown) on a loop tape of a hook-and-loop fastener. The upper movable blade 19 is driven to move its comb teeth 30 from the position of FIG. 4B to the position of FIG. 4A preparatory to the next loop cutting. The loop sheet 10, as it is further advanced, turns around the downwardly sloping corner guide surface 16, during which time the severed leg 12*a* and the hook 26 of each loop 12 are guidedly received in adjacent two of the guide grooves 24 in the stationary blade 18, as shown in FIG. 5. When the severed loops 12 arrive at the outlets of the respective guide grooves 24 where the stationary comb teeth 22 are formed, the lower movable blade 20 is driven to shift its comb teeth 33 rightward from the position of FIG. 6A to the position of FIG. 6B with the result that the severed leg 12*a* of each loop 12 is further cut at the second cutting point 34 (FIG. 3) near the foundation fabric 11 while the leg 12*a* is still held stable in the guide groove 24. At this time, the cut debris 29 (FIG. 1) is temporarily stored in the channel 28 and then discharged from the channel 28 outside the loop cutter 17. The lower movable blade 20 is driven to move its comb teeth 33 from the position of FIG. 6B to the position of FIG. 6A preparatory to the next loop cutting. The rate of advance of the loop sheet 10 is so synchronized with the reciprocation of the movable blades 19, 20 that the movable blades 19, 20 make one reciprocation between the positions shown respectively in FIGS. 4A and 6A and the positions shown respectively in FIGS. 4B and 4B, each time a loop 12** reaches the cutting zone.

Although various minor modifications may be suggested by those versed in the art, it should be understood that I wish to embody within the scope of the patent warranted hereon, all such embodiments as reasonably and properly come within the scope of my contribution to the art.

What I claim is:

1. A method of producing hooks on hook-and-loop fasteners, comprising the steps of:

(a) introducing a plurality of parallel spaced first stationary cutting comb teeth of a stationary blade into loops projecting from a foundation fabric of a loop sheet as the loop sheet is fed along a path;

(b) cutting the loops from the outside thereof on one of the legs thereof at a first point near heads of the respective loops by reciprocating a plurality of parallel spaced first movable cutting comb teeth of a first movable blade in a direction perpendicular to the axes of the first stationary cutting comb teeth while the loops are guided in a first plane along the first stationary cutting comb teeth, thereby producing a hook from each loop thus severed;

(c) then guiding the severed leg and the hook of each severed loop in a second, different plane to move in and along an adjacent pair of parallel spaced guide grooves defined in the stationary blade and extending from the first stationary cutting comb teeth; and (d) thereafter, further cutting the severed leg from the outside of each severed loop at a second point near the foundation fabric by reciprocating a plurality of parallel spaced second movable cutting comb teeth of a second movable blade in a direction perpendicular to the axes of a plurality of second stationary cutting comb teeth disposed on the stationary blade at one end of the guide grooves remote from the first stationary cutting comb teeth while the severed leg is held in one of the two adjacent guide grooves.

* * * * *